US007422526B2

(12) United States Patent
Nemeckay

(10) Patent No.: US 7,422,526 B2
(45) Date of Patent: Sep. 9, 2008

(54) GOLF PUTTER AND METHOD OF CONVERTING

(76) Inventor: Stephen Nemeckay, 11060 Peerless, Detroit, MI (US) 48224

( * ) Notice: Subject to any disclaimer, the term of this patent is extended or adjusted under 35 U.S.C. 154(b) by 0 days.

(21) Appl. No.: 11/357,557

(22) Filed: Feb. 17, 2006

(65) Prior Publication Data

US 2006/0183563 A1 Aug. 17, 2006

Related U.S. Application Data

(60) Provisional application No. 60/654,053, filed on Feb. 17, 2005.

(51) Int. Cl.
*A63B 53/16* (2006.01)

(52) U.S. Cl. ..... 473/296; 473/299; 403/370; 403/371

(58) Field of Classification Search ..... 473/293–296, 473/298–299, 306–307, 239, 236; 280/823; 403/109.1, 109.4, 109.5, 110, 370–371, 374.4, 403/350–351, 359.1, 359.3, 359.6
See application file for complete search history.

(56) References Cited

U.S. PATENT DOCUMENTS

| | | | | |
|---|---|---|---|---|
| 3,539,185 | A * | 11/1970 | Andis | 473/296 |
| 4,856,929 | A * | 8/1989 | Smahlik et al. | 403/297 |
| 5,024,438 | A * | 6/1991 | Candow | 473/294 |
| 5,419,650 | A * | 5/1995 | Hoshino | 403/370 |
| 6,776,724 | B1 * | 8/2004 | Siemsglusz | 473/294 |
| 2006/0204322 | A1 * | 9/2006 | Roiser | 403/109.5 |

* cited by examiner

*Primary Examiner*—Stephen L. Blau
(74) *Attorney, Agent, or Firm*—The Weintraub Group, PLC

(57) ABSTRACT

An extender sleeve is provided for elongating and converting the shaft of a conventional golf putter wherein to enable the upper end of the converted putter shaft to be anchored against a portion of the golfer's body, such as the neck or belly, or gripped by one of the golfer's hand's, whereby to improve the swing of the golfer when putting a golf ball. The extender sleeve may be separately attached and removed from the putter shaft as desired or extended and retracted into the shaft for storage when not in use.

11 Claims, 7 Drawing Sheets

FIG 9
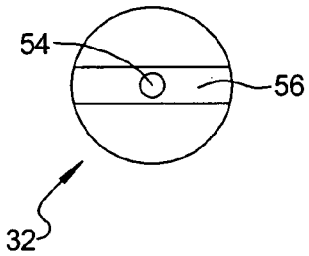
FIG 10
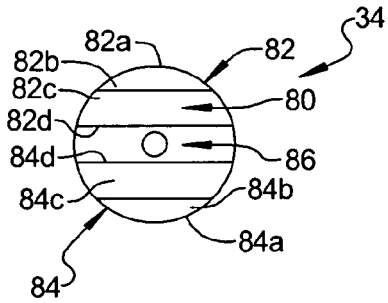
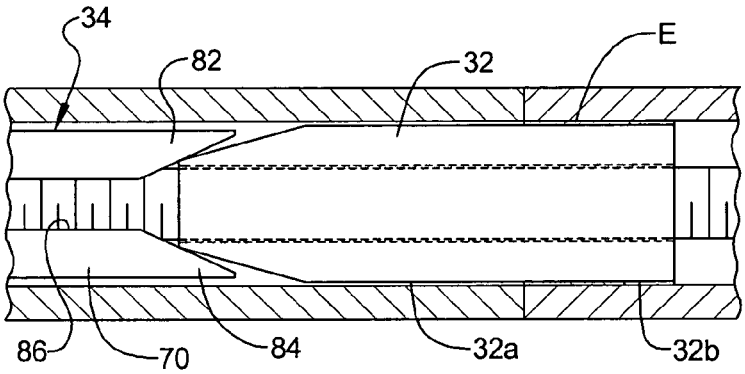
FIG 11
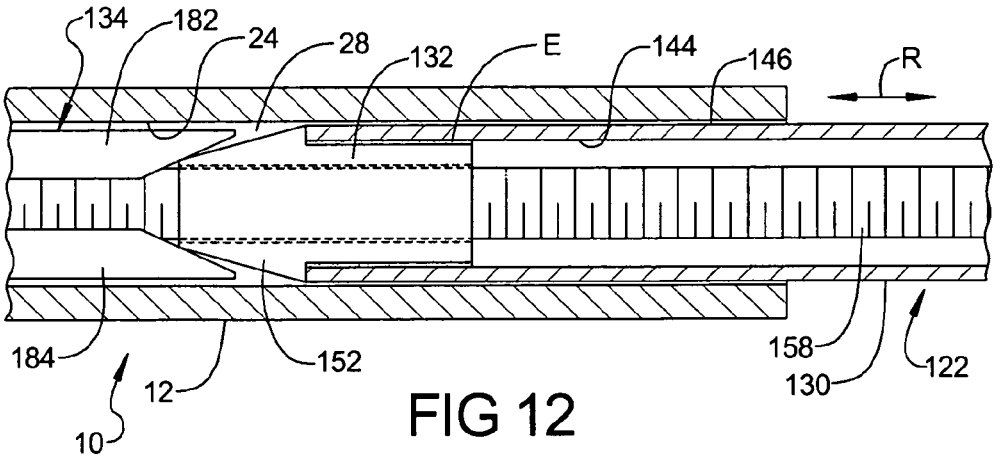
FIG 12

GOLF PUTTER AND METHOD OF CONVERTING

CROSS-REFERENCE TO RELATED APPLICATIONS

This is a completion Patent Application of co-pending U.S. Provisional Patent Application Ser. No. 60/654,053, filed Feb. 17, 2005, the disclosure of which is incorporated herein in its entirety.

BACKGROUND OF THE INVENTION

1. Field of the Invention

The present invention generally pertains to golf putters, and more particularly, to apparatus and method for converting the length of a conventional or standard putter into a mid-length or belly putter, or a long length putter, or a neck putter.

2. Description of the Prior Art

A conventional short putter 10, shown in FIGS. 1 and 5, comprises a shaft 12, a putter head 14 at the bottom end of the shaft, and a single grip 16 that extends along the top end portion 18 of the shaft 12. As shown in FIG. 1, a golfer grasps the single grip 16 with both hands when preparing to putt the ball. The top end 20 of the shaft is spaced from the golfer's body. A common problem that golfer's experience when putting is excessive wrist flexure, or hinging of the wrists, when swinging their putter, which flexure contributes to inconsistency of both direction and distance control.

An extreme form of poor putting is a condition known as the yips, whereby the golfer has greatly excessive wrist flexure in his stroke, sometimes accompanied by excessive body movement as well. Unwanted wrist action leads to a loss of control of the putter head before impact with the golf ball.

To improve short putting some golfers are no longer using the conventional or standard putter, which is about 34-36 inches in length, and are switching to a putter that engages a portion of the body to control the swing of the putter. Generally, these putters are termed a mid-length or "belly-putter" 10A, which is about 38-46 inches in length, a long putter 10B, which is about 48-52 inches in length, or a neck putter 10C, which is about 48-68 inches in length.

As these names suggest, a specific portion of the body is used to bring stability to the putt by creating a third point of contact, in addition to the golfer's two hands. The goal in these approaches is the same: to have one fixed center and one source of power.

The various forms of putters and position when used by a golfer are shown in FIGS. 1-4. As shown in FIG. 1, a golfer is using a standard or conventional putter 10. The hands grasp the grip and the golfer's body is spaced from the top end of the putter shaft.

As shown in FIG. 2, when using a belly-putter 10A, the top end 20A of the shaft 12A is anchored against the golfer's stomach (e.g., within the belly button), which serves as a fulcrum for making the stroke. A grip 16A is disposed between the opposite ends of the shaft 12A and, as with the standard putter 10, both hands of the golfer engage the grip 16A. That is, the posture of the golfer is not changed. The wrist action is easier to control as the dynamic of the swinging motion is altered by the length of the putter.

As shown in FIG. 3, when using the long putter 10B, the upper end 20B of the putter shaft 12B is designed to be anchored against the sternum of the golfer. Here, however, the golfer holds the upper end portion 18B of the putter shaft with the left hand and forces the top end 20B against the sternum and grasps a grip 16B at a medial location of the putter shaft with the right hand in the manner shown when using the conventional putter 10. In completing the putting stroke, the golfer either provides a bending and straightening of the right arm or the rocking of the shoulders. The main objective is to keep the body steady so that the chest acts as a fulcrum of a pendulum and produces a smooth pendulum like stroke.

As shown in FIG. 4, when using the neck putter 10C, the upper end 20C of the putter shaft 12C remains gently pressed against the neck of the golfer throughout the putting stroke to control the swing of the putter. The neck putter prevents the golfer's wrists from breaking down. Such a putter turns the putting stroke into a true pendulum swing that eliminates wrist hinge.

Examples of a golf putter and method of putting are disclosed in Hakas et al US 2003/0195057 A1, published Oct. 16, 2003, and Moore U.S. Pat. No. 6,213,891, issued Apr. 10, 2001.

Because golf equipment is expensive, the ability to convert a standard putter, such as into a belly-putter, long putter, and/or neck putter, would be desirable.

Typically, the standard putter shaft 10 is comprised of a long thin-walled hollow tube formed of a premium super-high modulus, graphite fiber material, possibly externally plated with chrome or stainless steel. The thin-walled structure places a limit on possible reconstructions. For example, internally threading the interior wall of the bore may weaken the tube.

Further, any redesign must not only meet and conform to USGA Rules, but also must be aesthetically pleasing to the golfer and be inexpensive.

As can be appreciated, there is an ongoing need for improvements in the field of golf equipment, such as putters.

An object of this invention is the provision of apparatus that is attachable to a standard or conventional golf putter whereby to convert the standard putter into a belly, long, or neck putter, depending on the needs and/or desires of different golfers.

Another object of this invention is the provision of apparatus, which minimizes the role of the wrist in the putting stroke by anchoring the putter to a fixed center, such as provided by the belly, sternum, or neck of the golfer, which apparatus is added to and extends the length of the commonly available standard putter.

Yet another object of this invention is an inexpensive method and apparatus for converting a standard golf putter.

SUMMARY OF THE INVENTION

The present invention is directed to apparatus for elongating and converting a conventional golf putter into a putter adapted to be anchored against a portion of the golfer's body whereby to improve the swing of golfer when putting a golf ball.

According to this invention, there is provided an improvement in a golf putter of the type including an elongated putter sleeve having cylindrical upper and lower end portions and a putter head secured to the lower end portion, the upper end portion being hollow and including an inner wall extending coaxially inwardly from the upper end thereof, the improvement comprising:

an elongated cylindrical extender sleeve, said extender sleeve having coaxial upper and lower end portions with the lower end of the extender sleeve being adapted to be connected to the upper end portion of the putter sleeve, a first lock member fixedly connected to the lower end portion of the extender sleeve for connecting the lower end portion of said extender sleeve to the upper end of said putter sleeve, said lock member including a V-shaped nose that projects from the lower end of the extender sleeve for fitment within the upper end portion of said putter sleeve, an axially elongated threaded rod, said rod supported for rotation in said extender sleeve, passing through said lock member, and having a forward end portion adapted to be fitted into the upper end portion of putter shaft, and a second lock member for frictional locking engagement with the inner wall of the putter sleeve, said second lock member being threadably connected to the threaded rod for relative movement therealong upon rotation of the rod and having a pair of elongated resiliently deflectable cantilever beams, the beams forming a V-shaped throat into which the V-shaped nose is interfitted, wherein following insertion of the interfitted nose and throat portions of the lock members into the putter sleeve and rotation of the rod, the second lock member is axially driven towards the first lock member, the nose is driven into the throat and against the beams, and the beams are deflected radially outwardly and into gripping engagement with the inner wall of the putter sleeve.

Preferably, the putter sleeve and extender sleeve each have a cylindrical exterior surface, which combine to form a smooth generally continuous cylindrical surface when the end face of the putter sleeve is abutted against the end face of the extender sleeve.

According to an embodiment herein, the improvement further comprises means for stiffening the interconnection between the putter sleeve and the extender sleeve and resisting bending forces operating between the two sleeves.

The means for stiffening comprises the first lock member being formed to include an axially elongated cylindrical body including a rearward end portion having an outer cylindrical surface and a length extending several diameters inwardly of the extender sleeve from the end face thereof, and a forward portion having an outer cylindrical surface and a length extending several diameters inwardly of the putter sleeve from the end face thereof and terminating in the V-shaped nose, the outer cylindrical surfaces of the cylindrical body forming a clearance fit engagement with the cylindrical inner walls of the respective sleeves into which inserted.

The second lock member further comprises an axial slot, the slot being generally parallel to a plane passing through the geometrical central axis of the lock member and extending axially rearwardly of the root of the V-shaped throat to increase the flexibility and ability of the cantilever beams to deflect radially outwardly upon their engagement by the V-shaped nose.

The V-shaped nose and throat are disposed in centered relation with the central geometrical axis interfitted in nested relation, and relatively movable towards one another and between an unlocked position (or inoperable relation) and a locked position (or frictionally engaged relation) with the puffer shaft. Each V-shape forms an acute angle the vertex of which is centered on the axis. The acute angle may be referred to as "double included" in that the acute angle is bisected by the axis with half of the acute angle being above and below the axis. Preferably, the acute or "double included" angle of the V-shaped nose is less than the acute or "double included" angle of the V-shaped throat. That is depending on the application, the double included angle of the V-shaped nose may be greater than or less than the double included angle of the V-shaped throat. What is important is that the V-shaped nose (nested in the throat) push against the beams that form the throat and deflect the beams radially outwardly and into wedged frictional engagement with the inner surface of the puffer shaft.

In a particular application and putter sleeve, the double included angle determines the length of the cantilever beam and exterior surface thereof that is available for deflection into gripping engagement with the interior wall of the putter sleeve. For example, a small double included angle enables the cantilever beam length and the exterior cylindrical surface area thereof that can be deflected into gripping engagement with the interior wall of the putter sleeve. Conversely, a large double included angle decreases the beam length possible for a given putter sleeve.

According to this invention, the double included acute angle of the V-shaped nose is between about 35° and 70° and the double included angle of the throat is between about 30° and 40°. In one preferred embodiment, the double included angle of the nose is about 52° and the double included angle of the throat is about 35°.

Preferably, the improvement includes means at one end of the rod for rotating the rod. In this regard, the means for rotating comprises terminating the upper end of the rod with a nut, such as adapted to be engaged and rotated externally by an Allen wrench.

Preferably, the improvement includes the lock members being formed from a suitably machinable material, such as a polymer (e.g., ABS, an acetal, a homopolymer, Nylon and the like).

The first lock member is preferably comprised of a polymeric material, provided with a through bore, a counterbore at the rearward end face thereof, and provided with a thread engaging nut in the counterbore, for engaging the threaded rod.

Further, and according to another preferred embodiment, there is provided a combination comprising elongated first and second shafts, each said shaft being hollow in part and having an inner wall and said shafts having respective end faces in abutted relation, an elongated threaded rod disposed in said shafts, bearing means for supporting said rod in said second shaft at longitudinally spaced points, first and second lock members disposed in said first shaft and in interfitted relation with one another, said first lock member being threadably connected to said rod and including a pair of resilient radially expansible cantilever arms, said arms forming a V-shaped throat and each arm having a deflectable end, said second lock member including a rearward end portion fixedly secured to the inner wall of said second shaft and a forward end portion in the form of a V-shaped nose, said second lock member being movable towards and away from said first lock member upon rotation of said rod whereby the nose is driven tightly within said throat and the deflectable ends are driven outwardly and into forcible holding retaining engagement with the inner wall of the first shaft.

According to this latter embodiment, the forward end portion of the second lock member, in part, is fixedly secured to the inner wall of the first shaft.

Further and according to another embodiment of this invention there is provided a method for mounting a cylindrical extender sleeve to the upper end of a hollow cylindrical putter shaft, the steps comprising providing an extender sleeve of predetermined length and having a forward end, the extender sleeve including a threaded rod journalled for rotation, first and second lock members dimensioned for sliding clearance fitment within the upper end of the putter shaft and having, respectively, rearward and forward end portions, wherein the rearward end portions of said first and second lock members are, respectively, non-rotatably affixed to the sleeve and threadably engaged with the rod and movable therealong, and the forward end portions of one and the other of said lock members are V-shaped and form a nose that is interfitted within a throat, the throat formed by a pair of resilient cantilever arms which are deflected outwardly by the nose, inserting the nose and throat into the putter shaft, and rotating the rod relative to the extender sleeve to simultaneously pull the extender sleeve and nose towards the putter shaft and the nose into the throat, continued rotation driving the nose against the cantilever arms and driving the arms radially outwardly and into frictional holding retaining engagement with the inner wall of the putter shaft.

According to one preferred embodiment, a bearing mount is provided at the upper end portion of the extender sleeve. In connection therewith, the upper end of the threaded rod is provided with an engageable nut, which is supported on the bearing mount. The nut is engageable by a wrench and provides means for rotating the rod.

According to an important aspect of this invention, the outer circumference of the adapter is configured to be clearance fit within the standard putter. So inserted, the lock member may be positioned at a location that is remote to the top end face of the standard putter and the locking arms driven outwardly and into locked gripping engagement with the sleeve. So positioned, adapter and the putter sleeve are then be locked in place. Importantly, the adapter will serve to convert the standard putter into a putter of any desired length. Also, the adapter can be retracted into the putter for storage, or removed entirely.

According to another important embodiment, the forward end portion of the putter shaft is slitted and externally roughened and inserted within the extender sleeve, causing the lock members of the extender sleeve to be disposed within the putter shaft, with rotation of one lock member towards the other lock member forcing the slitted tubular wall of the putter shaft into frictional locking engagement with the inner wall of the extender sleeve.

The present invention will be more clearly understood with reference to the accompanying drawings and to the following Detailed Description, in which like reference numerals refer to like parts and where:

BRIEF DESCRIPTION OF THE DRAWINGS

FIGS. 9 and 10 are front end views of one and the other of the lock members provided at the lower end of the adapter.

FIG. 11 is a cross-section assembly view of another embodiment of a putter assembly and conversion according to this invention.

FIG. 12 is a cross-section assembly view of yet another embodiment of a putter assembly and conversion according to this invention.

DETAILED DESCRIPTION OF THE PREFERRED EMBODIMENT

Figure 5:
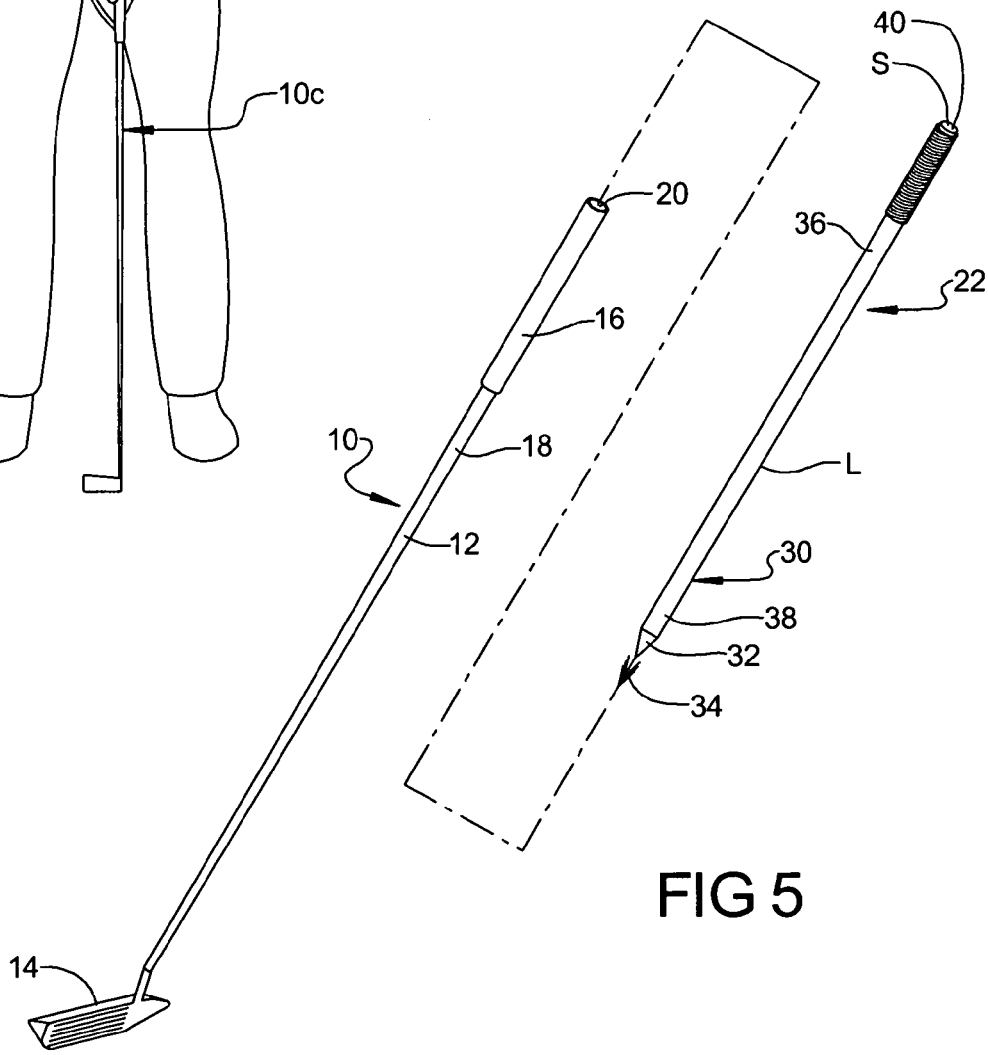
FIG. 5 is an assembly view wherein an adapter according to this invention is positioned for fitment into the upper end portion of the sleeve of the standard golf putter of FIG. 1 whereby to convert the standard golf putter into one of the golf putters shown in FIGS. 2-4.

Turning now to the drawings, FIG. 5 illustrates an adapter 22 positioned for attachment to the top end of the standard golf putter 10 whereby to extend the length of the golf putter by an amount sufficient to engage a portion of the golfer's body and stabilize the resulting golf putter. The adapter 22 is of a length "L", attaches to an approved putter 10, and extends the length of a standard putter in a manner to meet the requirements of the USGA Rules as regards the putters 10A, 10B, or 10C described hereinabove.

Figure 6:
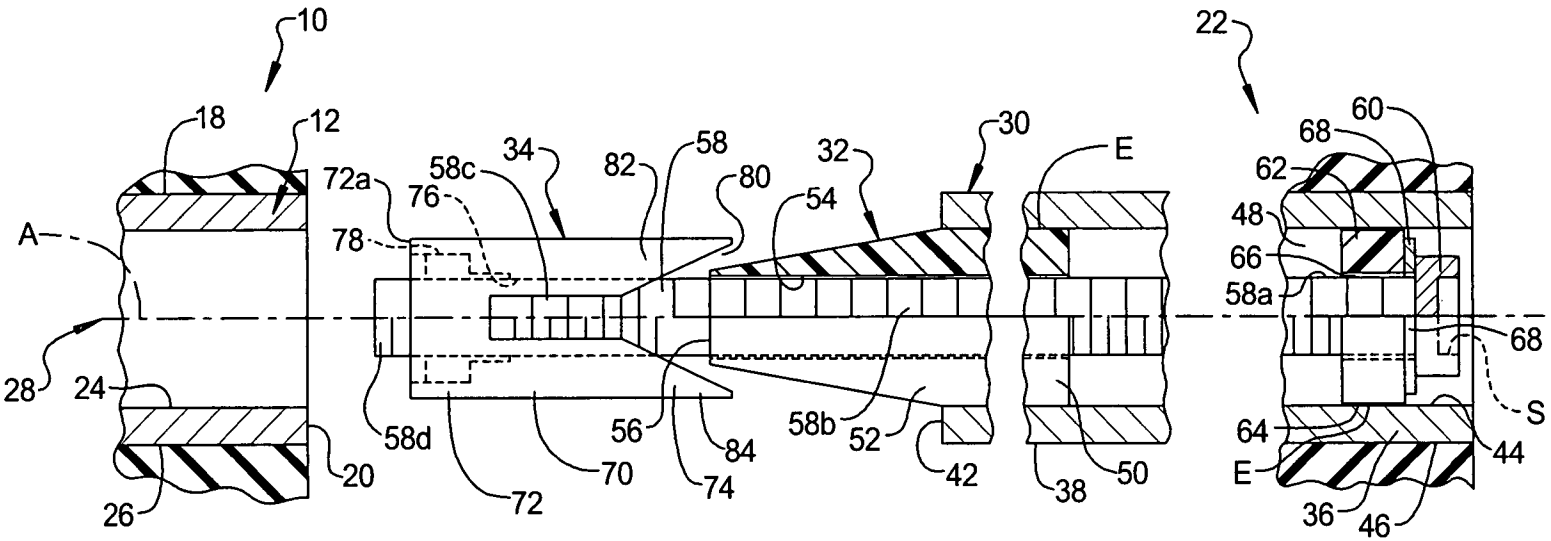
FIG. 6 is a side view in cross-section of the lower end portion of the adapter and interlockable lock members thereat in nested relation with one another and positioned for fitment into the upper end portion of the putter sleeve of the standard golf putter.

As shown in FIG. 6, the upper end portion 18 of the putter shaft or sleeve 12 is elongated, hollow, and formed with generally cylindrical inner and outer walls 24 and 26. The walls 24 and 26 are generally concentric with one another and coaxial with a central geometric axis "A" through the putter shaft 12. The inner wall 24 extends coaxially inwardly from the top end 20 of the putter shaft and forms a central chamber or hollow 28 in the interior of the putter shaft 12.

The adapter 22 comprises an elongated, hollow, generally cylindrical extender sleeve 30, first and second lock members 32 and 34, and an elongated externally threaded drive rod 58 interconnecting and mounting the lock members in close nested facing relation with one another. The lock members are adapted to be inserted into the chamber 28 formed at the upper end of the putter shaft 12.

The extender sleeve 30 has upper and lower end portions 36 and 38 and respective ends 40 and 42, and cylindrical interior and exterior walls 44 and 46. The walls 44 and 46 of the extender sleeve 30 are generally concentric with one another and coaxial with a central geometric axis extending through the sleeve. The inner wall 44 extends between the upper and lower ends 40 and 42 and forms an interior chamber 48 therebetween.

In general, the extender sleeve 30 may be of any material, either desired by the user, or dictated by Rules of the Professional Golf Association. According to this invention, the sleeve 30 is complementary to, and possibly the same as, the lightweight carbon fiber material oftentimes used in constructing the sleeve 12 of the PGA approved golf putter 10. Further, when the extender sleeve 22 and the putter sleeve 12 are joined together, the exterior surfaces of the walls 26 and 46 form a smooth transition surface and the axes of the two sleeves 12 and 30 are aligned on the same geometrical axis "A".

The first lock member 32 has a generally cylindrical rearward end portion 50, a forward end portion in the form of a truncated V-shaped nose 52, and a central bore 54 extending coaxially between the opposite ends of the lock member. The rearward end portion 50 is clearance fit into the chamber 48 formed in the lower end portion 38 of the extender sleeve 30 and is fixedly secured to the interior wall 44 thereof. In such securement, the lock member 32 is prevented from rotating relative to the extender sleeve 30 and the central bore 54 is coaxially disposed with the geometric axis of the extender sleeve. The nose 52 projects outwardly and away from the lower end 42 of the extender sleeve and terminates in a forward transverse end face 56.

According to this invention, the lock member 32 is secured to the extender sleeve 30 by a suitable adhesive or epoxy "E", such as known by those skilled in the art.

The axial rod 58 is elongated, externally threaded, and dimensioned to extend through the interior chamber 48 and between the opposite ends 40 and 42 of the sleeve 30 and includes an end portion that extends outwardly and away from the lower end 42 of the extender sleeve 30 by an amount sufficient to mount the lock member 34 in nested relation with the lock member 32 and position the lock members within the chamber 28 provided at the upper end of the putter sleeve 12. The rod 58 has an upper end 58*a* journalled for rotation in the upper end portion 36 of the extender sleeve 30, a medial portion 58*b* disposed for rotation in the central bore 54 of the lock member 32, a lower end portion 58*c* projecting from the end face 42 of the extender sleeve and threadably engaged with the lock member 34, and a lower end 58*d*. The lower end portions 58*b* and 58*c* project, at least in part, outwardly and away from the lower end 42 of the extender sleeve 30 by an amount sufficient to mount the lock member 34 for positioning insertion into the chamber 28 of the putter sleeve 12.

The upper end 58*a* of the rod 58 is terminated by or provided with a screw head 60. According to an embodiment of this invention, the screw head 60 is provided with a socket "S", which is adapted to receive and be turned by an Allen wrench (such as illustrated in phantom in FIG. 7). As such, the rod 58 may be externally adjusted as needed.

A cylindrical bearing head 62 is provided interiorly of the chamber 48 at the upper end portion 36 of the extender sleeve 30 to position and support the screw head 60 for rotation of the threaded rod 58. The bearing head 62 has an outer circumferential wall 64 fixedly secured to the interior wall 44 of the sleeve 30 and a bore 66 extending through the center of the head 62 for axially aligning and passing the threaded rod 58. Preferably, the circumferential wall 64 is fixedly secured by a suitable adhesive or epoxy "E".

In the embodiment shown, a washer 68 of a suitable steel is provided between the screw head 60 and the bearing head 62 to support and resist wear caused by rotation of the screw head 60 relative to the bearing head 62.

Further, the bearing head 62 is preferably comprised of a suitable polymeric material, such as Nylon or Delrin, or other suitable machinable polymeric material.

The second lock member 34 is threadably attached to the lower end portion 58*c* of the threaded rod 58 and axially positionable therealong, between the lower end 58*d* of the rod 58 and the end 42 of the sleeve 30 and axially movable towards and away from the end face 56 of the truncated V-shaped nose of the lock member 32. The second lock member 34 comprises a generally cylindrical body 70 of flexible material and includes forward and rearward end portions 72 and 74, and a threaded bore 76 that extends through the center of the body 70. The forward end portion 72 terminates in an end face 72*a* proximate to the end portion 58*d* of the rod 58. Further, the end face 72*a* is counterbored and fitted with an internally threaded nut 78, which nut is fixedly secured and threadably engaged with the external thread formed on the lower end portion 58*c* of the rod 58. The nut 78 enables the lock member 34 to be moved along the end portion 58*c* of the rod 58 as a result of rotation of the rod relative to the sleeve 30, in a manner to be described herein below.

The lock member 34 is configured to be slidably fit or coaxially inserted into the chamber 28 formed in the upper end portion 18 of the putter shaft 12. So inserted, the cylindrical body 70 is centered with and encircled by the interior wall 24 of the putter sleeve 12. Further, the axis of the rod 58 and lock members 32 and 34 are coaxially aligned with the central geometrical axis "A" of the putter sleeve 12.

The rearward end portion 74 of the lock member 34 is disposed in confronting juxtaposed facing relation with the V-shaped nose 52 of the first lock member 32 and forms a truncated V-shaped throat or opening 80 for receiving the nose 52. The truncated V-shaped throat 80 includes a pair of like shaped cantilever arms, beams, or wings 82 and 84 that form a V-shaped nest or throat sized to receive the truncated V-shaped nose 52. The V-shape nose 52 is blunt and adapted to engage and laterally deflect the beams 82 and 84 radially outwardly from the geometrical axis and into engagement with the inner wall 24 of the sleeve 12.

The cantilever arm 82 and 84, respectively, is defined by a semi-cylindrical exterior surface 82*a* and 84*a*, a transverse end face 82*b* and 84*b*, a flat engagement surface 82*c* and 84*c*, and a planar wall or face 82*d* and 84*d*. The exterior surface 82*a* and 84*a* and flat end face 82*d* and 84*d* a deflectable end tip of the beam. The beam and exterior surface 82*a* and 84*b*, proximate to the tip, is adapted to be deflected radially outwardly and into frictional engagement with the inner wall of the sleeve.

The planar walls 82*d* and 84*d* are in parallel spaced relation to one another and with a horizontal plane disposed on the center axis of the bore 76 passing through the body 70 of the lock member 34. The walls 82*d* and 84*d* form an axial slot 86 at the apex of the V-shaped throat 80.

The flat engagement surfaces 82*c* and 84*c* are at an acute angle to the geometrical axis through the center of the body 70 and cooperate to form, in part, the truncated V-shaped throat or opening 80, the apex of which is generally centered on the center axis of the bore. The axial slot 86 symmetrically aligned with the double included angle of the throat 80 and forms the root of the V-shaped opening 80. The flat faces 82*c* and 82*d*, and 84*c* and 84*d*, respectively, are continuations of one another and cooperate to define the transverse axial slot 86 that separates the two beams 82 and 84.

Importantly, the axial slot 86 enhances the ability of the beams 82 and 84 to deflect laterally and radially away from one another relative to the central axis "A".

Importantly, and according to this invention, the V-shaped nose 52 is received in the throat 80 and the angled faces thereof driven into engagement with the angled surfaces 82*c* and 84*c* of the cantilever beams 82 and 84, whereupon the exterior semi-cylindrical surfaces 82*a* and 84*a* thereof are deflected radially outwardly and the ends of the beams 82 and 84 driven into locking gripping engagement against the interior wall 24 of the putter sleeve 12.

Critical to this invention is that the second lock member 34 be comprised of a flexible material, such as Nylon. Further, the double included angle 88 of the blunt V-shaped nose 52 is preferably greater than the double included angle 90 of the V-shaped throat 80. As such, when the lock members 32 and 34 and the V-shaped portions 52 and 80 thereof are driven towards one another, the blunt nose 52 is driven deeply into the throat 80, towards the slot 86, and towards the rearward end 58*d* of the threaded rod 58. Further movement causes the forward end 56 of the nose 52 to be driven into engagement with the flat faces 82*c* and 84*c* of the cantilever beams or arms 82 and 84, whereupon the beams are progressively substantially simultaneously deflected radially outwardly and the respective end tips of the beams driven into engagement with the inner wall of the putter sleeve 12.

Preferably and according to this invention, the double included angle 88 of the nose 52 is between about 35° and 70° and the double included angle 90 of the throat 86 is between about 30° and 40°. In one embodiment, the double included angle 88 of the nose 52 is about 52° and the double included angle 90 of the throat 80 is about 35°.

The double included angles 88 and 90, the apices of which are centered on the geometrical axis and symmetrically disposed relative to one another, will to some degree determine the length of the cantilevered arms 82 and 84 needed, such as the deflectable free ends and outer exterior surfaces 82*a* and 84*a* that are deflected outwardly. A double included angle 88 that is smaller than about 35° will tend to increase the length of the beams 82 and 84 needed to deflect outwardly, thus increasing the amount and cost of materials needed. Conversely, a double included angle 88 that is greater than about 35° will tend to decrease the length of the beams 82 and 84 needed to deflect and complete a locking frictional engagement. In general, a "blunt" nose 52 will result in shorter beams.

Figure 13:
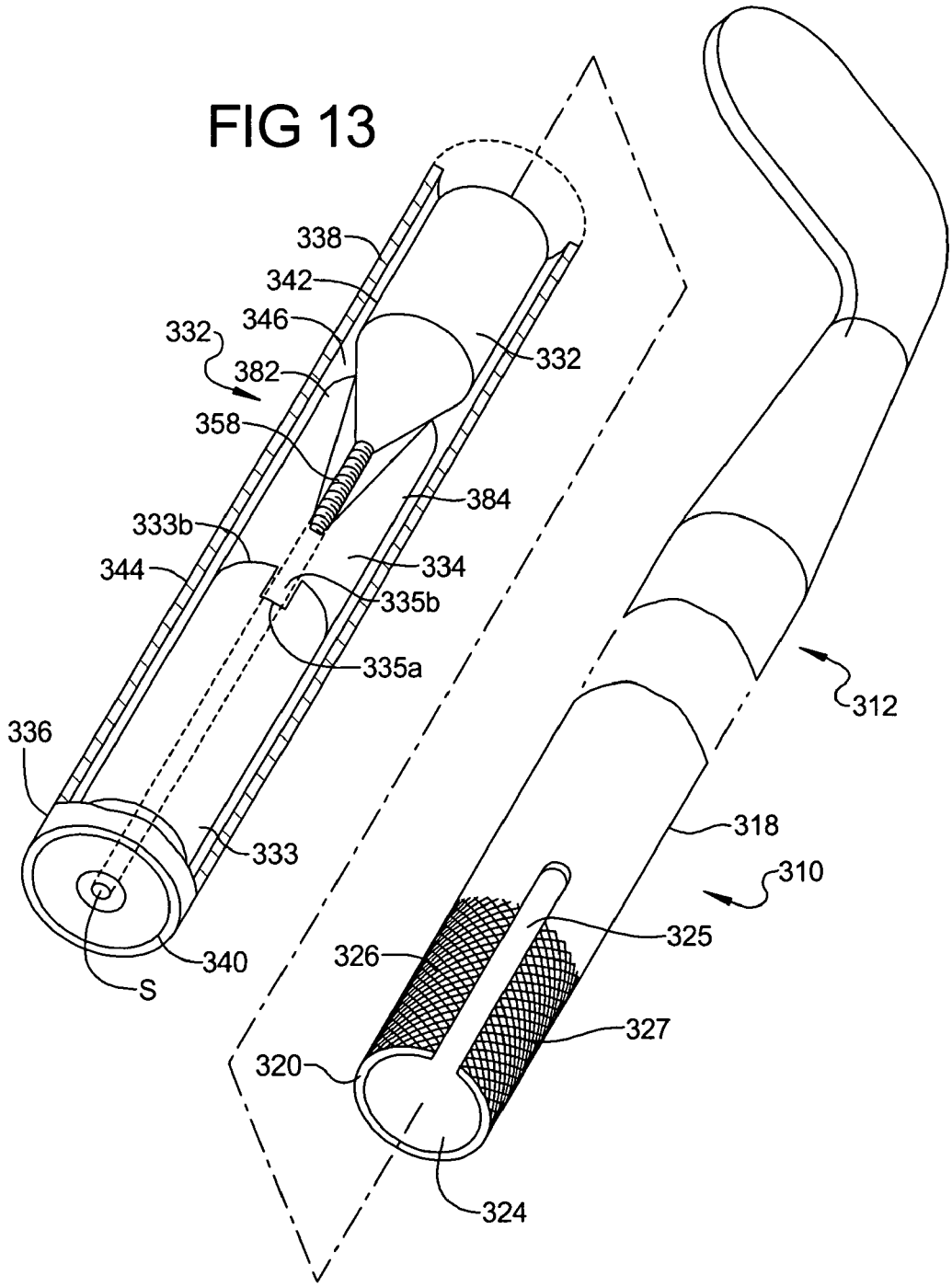
FIGS. 13 and 14 are exploded and cross-section assembly views of yet another embodiment of a putter assembly and conversion according to this invention.
Figure 14:
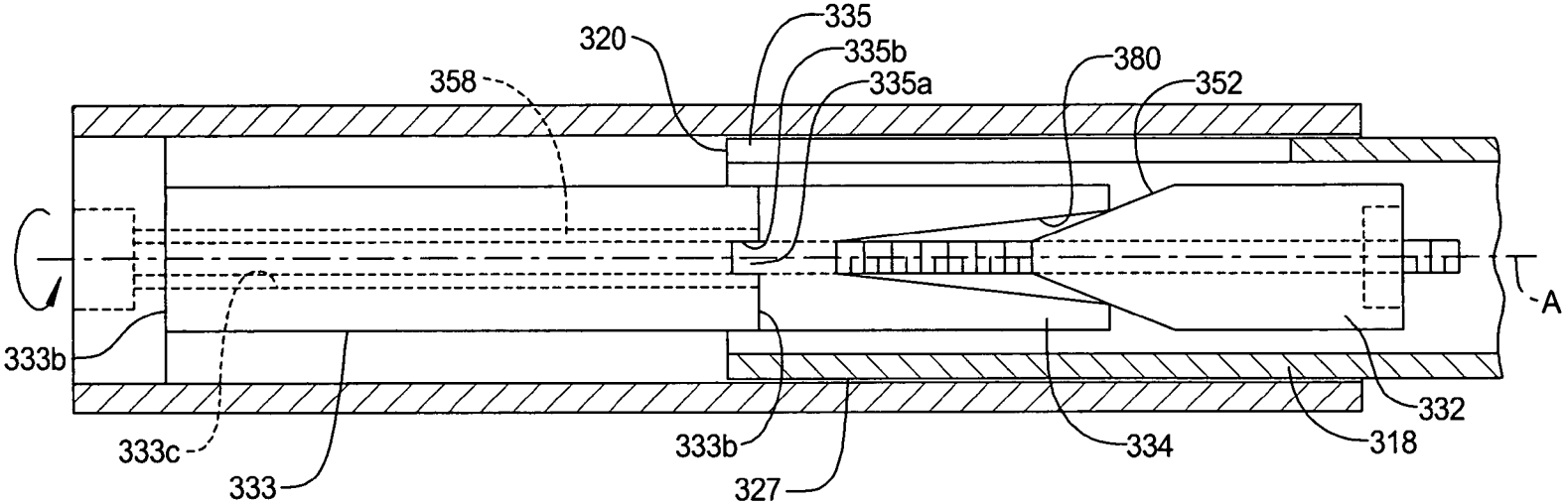

However, the dimensions of the locking members required to lock with the putter shaft will change, depending on the application, such as whether the extender sleeve and putter shaft are abutted (e.g., FIGS. 6-8), or the extender sleeve is inserted into the putter shaft (e.g., FIG. 12), or the putter shaft is inserted into the extender sleeve (e.g., FIGS. 13 and 14). That is, the cantilever beams may be longer or shorter depending on the engagement needed or amount of rotation need to drive the nose and throat together.

Further, the length of the axial slot 86 determines to a degree the ability of the arms to deflect upon contact when the nose 52 is received in the throat 80.

Preferably, in one embodiment, the first and second locking member 32 and 34 were about ⅝ inch diameter. The body 70 of the second locking member 34 was about 1⅜ inches long, end to end, the axial slot 86 was about 9/16 inches long, the axial distance from the front face 82*b* and 84*b* to the axial slot was about ½ inch, and the axial distance from the axial slot 86 (or root of the throat 80) to the rear face was about ½ inch. The body of the first lock member 32 was about 2 inches long, the distance from the rearward end face to the nose 52 was about 1 7/16 inches, and the nose 52 had a depth of about ½ inch from the transverse front end face 42 rearwardly.

Desirably, the radially expanded arms 82 and 84 provide threadless means for releasably securing the extender sleeve to the conventional putter.

Preferably, the first and second lock members are comprised of a material having the characteristics of being durable, resistant to chemicals and wear, having high strength, and low coefficient of friction. Desirably, the material will provide high strength and stiffness along with increased dimensional stability and ease of machining. Additionally, due to the fact that the golf putter is exposed to rain and other outside environmental conditions, the material should have a low moisture absorption.

According to this invention, the bearing and the lock members are comprised of a thermoplastic, such as acrylonitrile-butadiene-styrene (ABS), a homopolymer, acetal and acetal copolymers (e.g., Delrin®), Nylon, vinyl polymers (e.g., Teflon® and PTFE), HDPE, LDPE, and a polyetherimide (e.g., Ultem®), In use, as shown in FIG. 5, the extender sleeve 30 of the adapter 22 is coaxially aligned with the putter shaft 12, with the top end face 20 of the shaft 12 facing the lower end face 42 of the extender sleeve 30. The length "L" of the sleeve 30 and of the threaded shaft 58 are determined in advance, depending on the conversion desired.

The nose 52 is interfitted within the throat 80. The nose 52 is slightly backed off from engagement with the cantilever beams 82 and 84. In such interfitment, rotation of the nose causes rotation of the lock member 34 into which the nose is interfitted.

If desired, adhesive is provided between the outer surface of the nose 52 or the interior surface of the wall 12. Upon drying, relative rotation between the sleeves is prevented.

The adapter 22 is moved towards the putter causing the first and second lock members 32 and 34 to be inserted into the chamber 28 of the putter sleeve 12. The end face 42 of the extender sleeve 30 is brought into abutment with the end face 20 of the putter shaft or sleeve 12. The adhesive is allowed to dry, bonding the exterior surface of the first lock member to the interior wall of the putter shaft.

Figure 7:
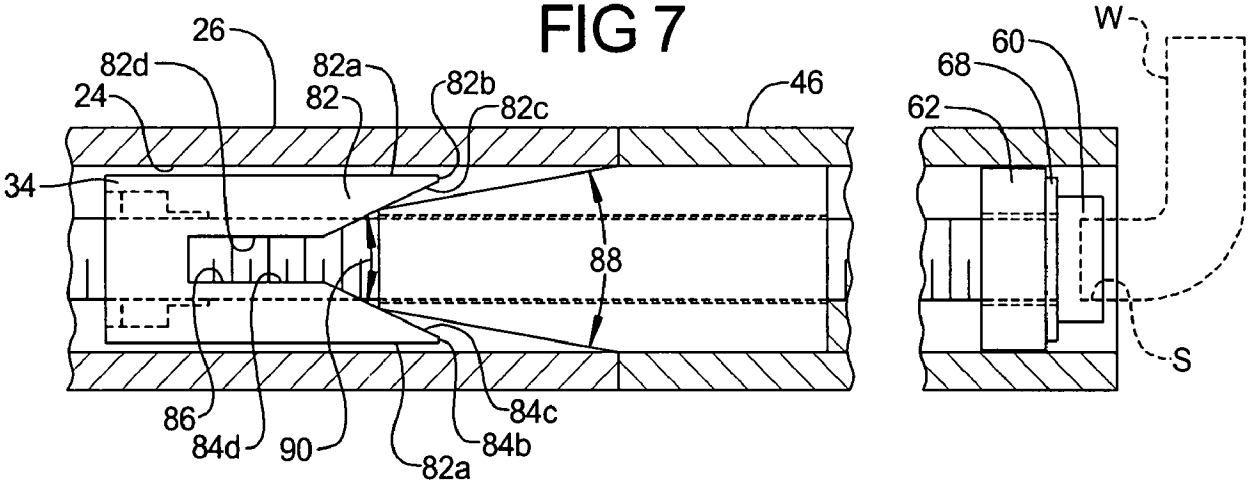
FIG. 7 is a side view in cross section wherein the lower end of the adapter is abutted against the upper end of the putter sleeve and the lock members are positioned within the upper end portion of the putter sleeve.
Figure 8:
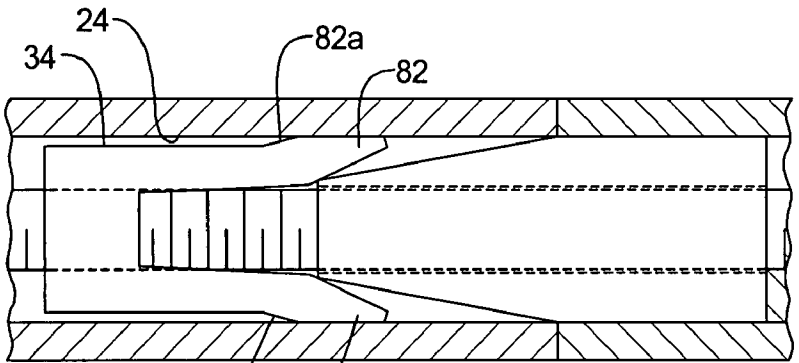
FIG. 8 is a side view in cross-section of a final assembly wherein the lock members are driven together and a pair of beams of one of the lock members are deflected radially outwardly and driven into gripping relation against the inner wall of the putter sleeve.

An Allen wrench (as shown in FIG. 7) is inserted into the socket of the fastener head 62 and rotated, causing the threaded rod 58 to rotate. This rotation of the rod 58 relative to the lock member 34 operates on the nut 78 in the second lock member 34 and draws the second lock member 34 towards the first lock member 32. Further rotation draws the nose 52 against the cantilever beams 82 and 84, camming against the beams and causing the beams to deflect outwardly. Further camming pushes the outer semi-cylindrical surfaces 82*a* and 84*a* into gripping engagement with the interior wall of the putter.

According to another embodiment of this invention, as shown in FIG. 11, to improve the axial integrity of the interconnection, the first lock member 32 is axially elongated and provided with forward and rearward end portions 32A and 32B, the length of which portions is many diameters long. The extended length portions 32A and 32B of the lock member 32 are clearance fit within the mating end portions 38 and 26 of the extender and putter sleeves 30 and 12, respectively. Such extended portions of the lock member 32 will increases the area of engagement of the lock member with the inner walls of the sleeves 30 and 12 when abutted and resist any tendency of the assembled product to sway (i.e., inhibit the two sleeves from flexing or bending from axial alignment relative to the central axis "A").

In FIG. 11, the rearward end portion 32A of the lock member 32 is shown adhesively secured to the inner wall of the extender sleeve 30. In some applications, due to the extended length afforded by the end portions 32A and 32B of the first lock member 32, the forward end portion or nose 52 of the first locking member 34 is not adhered to the inner wall of the sleeve 30.

Figure 1:
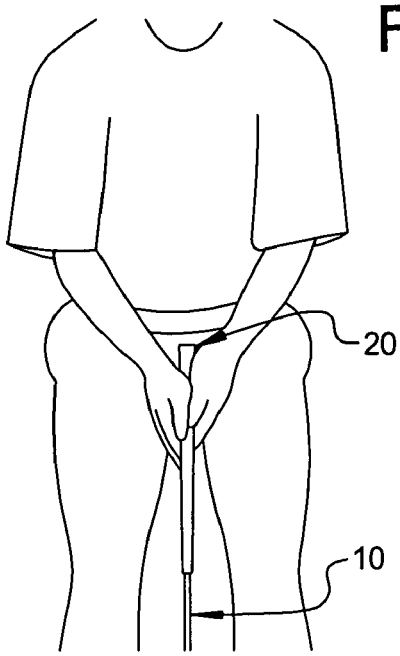
FIG 1 PRIOR ART
FIG. 1 is a perspective view showing a conventional short putter with a short grip and a method of use wherein the golfer grasps the single grip with both hands.
Figure 2:
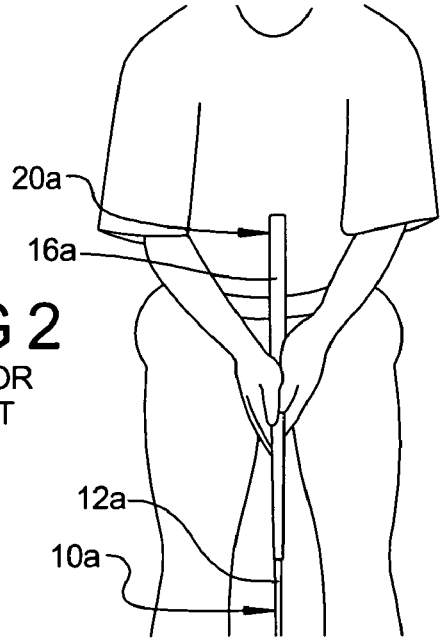
FIG 2 PRIOR ART
FIG. 2 is a perspective view showing a mid-length or belly putter and a method of use wherein the golfer grasps a single grip with both hands and the upper end of the putter is positioned in the belly of the golfer.
Figure 3:
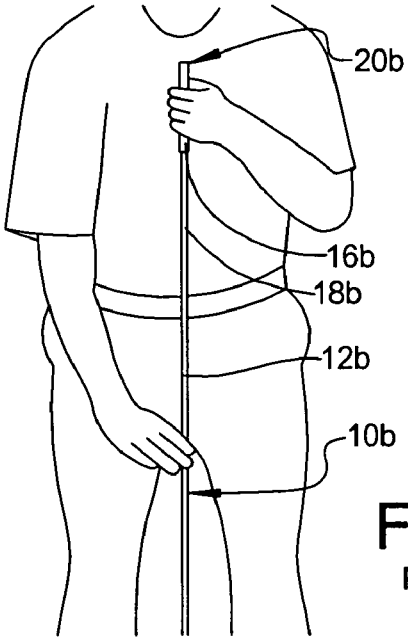
FIG 3 PRIOR ART
FIG. 3 is a perspective view showing a long putter and a method of use wherein the upper end portion of the putter shaft is positioned against the golfer's chest.
Figure 4:
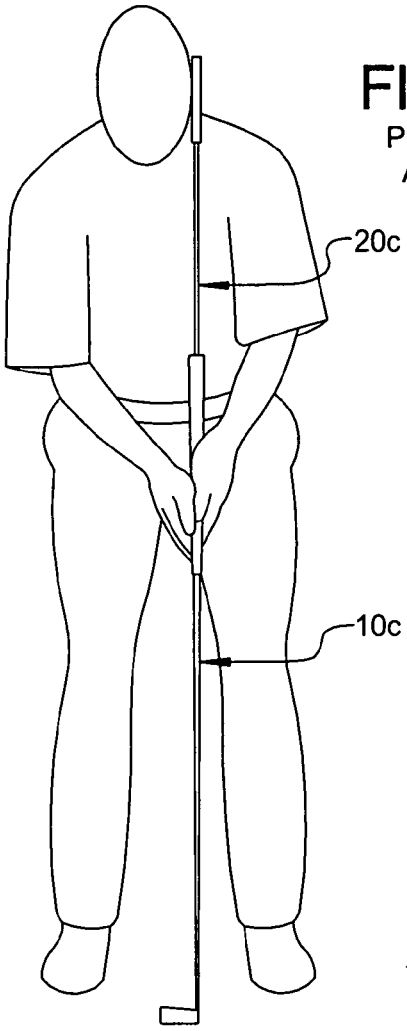
FIG 4 PRIOR ART
FIG. 4 is a perspective view showing a neck putter and a method of use wherein the golfer grasps the putter shaft at a midpoint of the shaft and positions the upper end portion of the putter shaft against the golfer's neck.

Referring to FIG. 12, an important aspect of this invention is the provision of an adapter 122, which enables the standard putter 10 to be converted into a putter of any desired length, such as shown in FIGS. 2-4. In such conversion, the adapter 122 may be totally retracted within the chamber 28 formed in the putter sleeve 12, partially withdrawn and locked in place wherein to provide the golfer with a belly putter 10A, a long length putter 10B, or a neck putter 10C, or completely withdrawn.

The adapter 122 is similar to that described above and includes an extender sleeve 130, a first lock member 132 with tapered nose 152, a second lock member 134 with deflectable beams 182 and 184, and a threaded rod 158 extending through the adapter. The extender sleeve 130 and sleeve 12 are dimensioned such that the extender sleeve 130 may slide in a clearance fit relative to the inner wall 24 of the putter sleeve 12. The forward end portion or nose 152 is connected or fixed to the inside wall 144 of the extender sleeve 130 and the outer circumference of the lock member 134 forms a smooth transition with the outer surface 146 of the extender sleeve 130 to enhance slidable fitment of the nose portion 152 into the chamber 28 of the putter 10.

So inserted, the extender sleeve 130 may slide axially back and forth relative to the inner chamber 28 of the putter sleeve 12, as shown by the arrow "R". When the adapter 122 is positioned where desired relative to the putter sleeve 12, the threaded rod 158 is operated by the Allen wrench, in the manner described herein, whereupon the lock members 134 and 134 move towards one another and the nose 152 will drive the beams 182 and 184 outwardly and into gripping engagement with the inner wall 24 of the putter sleeve 12.

FIGS. 13 and 14 illustrate another arrangement according to this invention for converting a golf putter. Referring to FIG. 13, a golf putter 310 is positioned for assembly to an extender sleeve 322. In this arrangement, the golf putter includes a hollow tubular shaft 312 wherein the upper end portion 318 is elongated, hollow, and formed with generally cylindrical inner and outer walls 324 and 326, which are generally concentric with one another and coaxial with the central axis through the putter shaft. The cylindrical walls 324 and 326 extend inwardly from the top end 320 of the shaft and rearwardly toward the putter head.

Importantly, an elongated slit 325 extends axially inward from the top end 320 of the shaft to weaken and make the upper end portion of the putter shaft wall capable of being deflected radially outwardly. In some applications, a second or third slit may be provided in the shaft wall, resulting in the end portion of the putter shaft wall being divided into separately deflectable arcuate beam sections. Further, and an important aspect of this invention, the outer surface of the outer wall 326 is slightly roughened at 327 to provide the surface with a frictional gripping capability.

The extender sleeve 322 is hollow, tubular, has upper and lower end portions 336 and 338 and respective ends 340 and 342, and cylindrical inner and outer walls 344 and 346 extending coaxially between the ends of the sleeve. The extender sleeve 322 is dimensioned to telescopically slidably fit about and encircle the outer wall 326 of the putter shaft. So positioned, the inner wall 346 of the extender sleeve 322 encircles the roughened outer surface portion 327 of the putter shaft.

The extender sleeve 322 is provided with an elongated partially externally threaded actuator rod 358, journalled for rotation within the sleeve in a manner described above, and a pair of lock members 332 and 334 disposed in nested confronting relation on the rod for insertion within the hollow of the putter shaft. The rod 358 and lock members 332 and 334 and their operation are as described herein above for the members 32, 34, and 58.

Further, as an aspect of this embodiment, a cylindrical spacer sleeve 333 having opposite ends 333*a* and 333*b* and a central bore 333*c* extending between the ends thereof is mounted to the actuator rod 358 and spaces the lock members 332 and 334 from the upper end 340 of the extender sleeve 322. One or more keys and keyways 335*a* and 335*b* operate between the lock member 332 and the spacer sleeve 333 to align and position the lock members relative to the extender sleeve 322. The lock member 332 and spacer sleeve 333 may in some applications be integrally formed. A separately provided spacer sleeve enables the user to customize the putter as desired.

As above described, the locke member 332 is preferably of Nylon or like flexible material, and the member 334 is of a more rigid material, such as Delrin. The spacer sleeve 333 enables the putter shaft to be extended, such as from 36 inches to 39 inches.

FIG. 14 illustrates an assembly wherein the extender sleeve 333 is connected to the upper end portion of the putter shaft. As shown, the upper end portion 318 of the putter shaft 310 is telescopically received within the hollow formed at the end 342 of the extender sleeve 333 and the lock members 332 and 334 are positioned inwardly of the forward end 320 of the putter shaft 310. The lock member 334 is disposed at the forward end of the actuator rod 358 and faces rearwardly towards the lock member 332. The V-shaped throat 380 of the lock member 334 opens rearwardly and receives the truncated V-shaped nose member 352 of the lock member 332.

When the extender sleeve 333 and the putter shaft 310 are assembled together, the cantilever beams 382 and 384 of the lock member 334 are juxtaposed with the axial slit 325 of the putter shaft. In the manner described herein above, an Allen wrench is used to rotate the journalled end of the actuator rod 358, causing the lock members 3324 and 334 to be driven together, whereupon the blunt nose 352 causes the beams 382 and 384 to be driven outwardly against the weakened tube section of the putter shaft and the roughened surface area 327 of the putter shaft to be driven into frictional gripping engagement with the inner wall of the extender sleeve. As before, the position of the lock members 332 and 334 may be reversed, such that the V-shaped nose 352 is at the forward end of the actuator rod and is directed rearwardly and the V-shaped throat of the lock member 334 faces forwardly.

While preferred embodiments of the present invention are shown and described, it is envisioned that those skilled in the art may devise various modifications of the present invention without departing from the spirit and scope of the appended claims. The invention is not intended to be limited by the foregoing disclosure, but only by the following appended claims.

What I claim is:

1. A length adjustable golf putter, comprising a puffer assembly, the assembly including a putter shaft and an extender sleeve separate from and mountable to the puffer shaft, the putter shaft having a lower end portion formed with a putter head and a hollow upper end portion having an open upper end, and said extender sleeve having upper and lower end portions, the lower end portion of said extender sleeve fitting slidably in concentric, telescoping relation into the hollow upper end portion of said putter shaft such that the extender sleeve is axially positionable in the hollow upper end portion of the putter shaft, and means for releasably locking the lower end portion of the extender sleeve relative to the upper end portion of said putter shaft whereby said extender is able to be telescopically adjusted and axially secured as desired relative to the putter shaft and the length of said putter assembly changed as desired, said means for releasably locking including a pair of nested lock members, one said lock member being fixedly disposed at the lower end of the extender sleeve and the other said lock member forming a radially expansible socket which receives and into which said one lock member is nested, and means for mounting the lock members in nested relation and in a manner that said other member is able to be axially urged towards and away from the expansible socket in an amount sufficient to cause the expansible socket to expand radially outwardly and inwardly and into and from frictional locking engagement with the inner wall of said putter shaft, the nested relation and shapes of the lock members being such that the lock members do not rotate relative to one another wherein said one lock member comprises a pair of angled surfaces that form a V-shaped nose and the other lock member comprises a pair of resilient radially deflectable cantilever lock beams that are mirror images of one another and include a pair of flat faces both in length and width that form a V-shaped throat, and the angled surfaces of the V-shaped nose engaging the flat faces and operating to deflect the lock beams radially outwardly.

2. The golf putter as claimed in claim 1, wherein each said lock member includes an axial bore, the axial bore through said other lock member being threaded, and said means for mounting comprises an axially elongated adjustment rod having upper and lower end portions and a medial portion, the lower end portion of said adjustment rod being partially threaded and extending outwardly and away from the lower end of said extender sleeve, the threaded lower end portion being threadably connected to the threaded bore of said other lock member and the medial portion extending through the axial bore in said one lock member in spaced relation thereto, and means for journaling the upper end portion of said adjustment rod for rotation relative to the extender sleeve, said nested lock members being connected to the lower end portion of said adjustment rod for fitment into the upper end portion of the putter shaft in a manner that when interfitted the radially expansible socket of said other lock member is disengaged with the inner wall of the putter shaft, and when the adjustment rod is rotated, the threaded interconnection causes the lock members to be driven in first and second directions and the socket to radially expand and frictionally engage the inner wall or contract and be spaced from contact with the inner wall, depending on the direction of rotation.

3. The golf putter as claimed in claim 2, wherein one and the other of said putter shaft and extender sleeve, respectively, form tubular female and male sections with the tubular female section being dimensioned to receive the tubular male section.

4. The golf putter as claimed in claim 3, wherein the tubular female section forms the upper end portion of the putter shaft, the tubular male section forms the lower end portion of the extender sleeve and is received within the putter shaft, and expansion by the rod of the expansible lock member causes the expansible lock member to frictionally engage the inner wall of the putter shaft.

5. A length adjustable golf putter of the type including an elongated putter shaft having an upper end portion terminating in an upper end, a lower end portion terminating in a putter head secured to the lower end portion, the upper end portion being hollow and including an inner wall extending coaxially inwardly from the upper end thereof, comprising:

an axially elongated tubular hollow extender sleeve, said extender sleeve having lower and upper end portions and outer and inner surfaces that extend generally coaxially between the lower and upper ends of extender sleeve, the outer surface being complementary to the inner wall and coaxially slidable in fitting relation within the hollow of said putter shaft, an axially elongated actuator rod, said actuator rod having an upper end portion, an externally threaded lower end portion and a medial portion, the upper end portion being disposed interiorly of said extender sleeve and the threaded lower end portion extending outwardly and away from the lower end of said extender sleeve, means for connecting the upper end portion of said actuator rod to the upper end portion of said extender sleeve for rotation relative to the hollow of said extender sleeve, means for rotating the actuator rod relative to the extender sleeve, a pair of lock members, said lock members being in nested nonrotatable relation with one another and including a socket member and a male member nested within said socket member, said male member having rearward and forward end portions and an axial bore extending therethrough, the rearward end portion of said male member being disposed within the hollow of and fixedly connected to the lower end portion of the extender sleeve, and the actuator rod, at least in part, being disposed in said axial bore for rotation relative thereto, and said socket member having a base, a forward end portion comprised of a pair of axially elongated, resilient, radially deflectable locking beams, and a threaded axial bore extending through said base, said threaded axial bore being threadably connected to said actuator rod, and said locking beams extending from the base and forming a radially expansible throat configured to receive and mate with the forward end portion of said male member, the nested forward end portions being configured that the nested members do not rotate relative to one another, wherein depending on the sense of rotation of the actuator rod, the threaded connection causes the socket member to move axially towards and away from the male member and the male member to deflect the locking beams radially outwardly and inwardly and into and away from frictional engagement with the inner wall of the putter shaft, further wherein the elongated locking beams are mirror images of one another and form a V-shaped throat that receive the forward end portion of the male member, each beam having a flat surface both in length and width that is engaged by the forward end portion of the male member and a deflectable end that is deflected radially outwardly and into frictional engagement with the inner wall of the putter shaft.

6. The length adjustable golf putter of claim 5, wherein said male member comprises a truncated V-shaped nose.

7. The length adjustable golf putter of claim 5, further comprising means for stiffening the interconnection between the putter shaft and the extender sleeve and resisting bending forces operating to misalign the axial alignment between the extender sleeve relative to the putter shaft.

8. The length adjustable golf putter of claim 5 wherein the throat and nose are centered on a common geometrical axis and have forward end portions interfitted with one another in nested relation, each V-shape being defined by an acute angle with the vertex of each acute angle being located on the common geometrical axis, and the acute angle of the nose is greater than the acute angle of the throat.

9. The length adjustable golf putter of claim 8, wherein the acute angle of the nose is between about 35° and 70° and the acute angle of the throat is between about 30° and 40°.

10. The length adjustable golf putter of claim 5, wherein said means for rotating the actuator rod comprises the upper end of the actuator rod being terminated in a nut, such as adapted to be engaged and rotated externally by an Allen wrench, wherein when the actuator rod is rotated, the nested lock members and the interengaged thread cause the socket member to be moved.

11. The length adjustable golf putter of claim 5, further wherein said socket member includes a transverse slot extending axially, the slot having opposed sidewalls that form continuations of the flat surfaces that form the V-shaped throat centered on the threaded axial bore and the center axis of the actuator rod, said slot increasing the ability of the locking beams to deflect radially upon axial engagement therewith by the male member.

* * * * *